US005720053A

United States Patent [19]

Menge

[11] Patent Number: 5,720,053

[45] Date of Patent: Feb. 24, 1998

[54] APPARATUS FOR REGULATING THE QUANTITY OF LIQUID FOR THE FLUSHING OF TOILET BOWLS

[76] Inventor: Heinrich Menge, Eissendorfer Pferdeweg 45, D-2100 Hamburg 90, Germany

[21] Appl. No.: 828,860

[22] Filed: Mar. 31, 1997

Related U.S. Application Data

[63] Continuation of Ser. No. 618,417, Mar. 15, 1996, abandoned, which is a continuation of Ser. No. 350,517, Dec. 6, 1994, abandoned, which is a continuation of Ser. No. 907,972, Jul. 2, 1992, abandoned.

[30] Foreign Application Priority Data

Jul. 5, 1991 [DE] Germany ..... 41 22 394

[51] Int. Cl.[6] ..... E03D 1/34

[52] U.S. Cl. ..... 4/325; 4/379

[58] Field of Search ..... 4/324, 325, 379, 4/381–384

[56] References Cited

U.S. PATENT DOCUMENTS

| | | | |
|---|---|---|---|
| 4,101,986 | 7/1978 | Ng et al. | 4/325 |
| 4,357,720 | 11/1982 | Stahli | 4/383 X |
| 4,800,596 | 1/1989 | Menge | 4/348 |
| 5,123,125 | 6/1992 | Menge | 4/249 |
| 5,265,282 | 11/1993 | Schmucki | 4/325 |
| 5,305,474 | 4/1994 | Nardi et al. | 4/324 |

*Primary Examiner*—Charles E. Phillips
*Attorney, Agent, or Firm*—Darby & Darby

[57] ABSTRACT

The quantity of water which is discharged from a flushing tank into a toilet bowl is regulated by accelerating or decelerating the descent of a float in a housing which is installed in the tank. The float carries an actuator which is provided with a valving element serving to seal an outlet of the tank when the float descends in the housing to a selected level as a result of flow of water from the housing into the tank through one or more openings in the housing. Each opening is controlled by a discrete valve which can be closed or opened to a selected extent by the actuator.

1 Claim, 6 Drawing Sheets

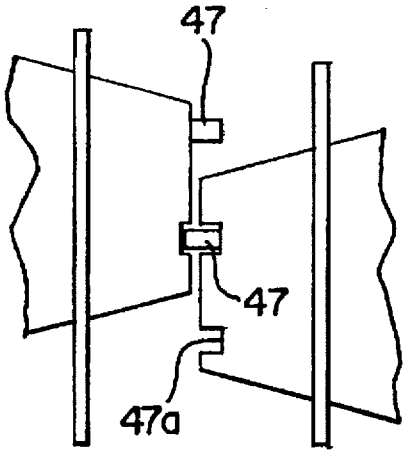
FIG. 4
FIG. 5
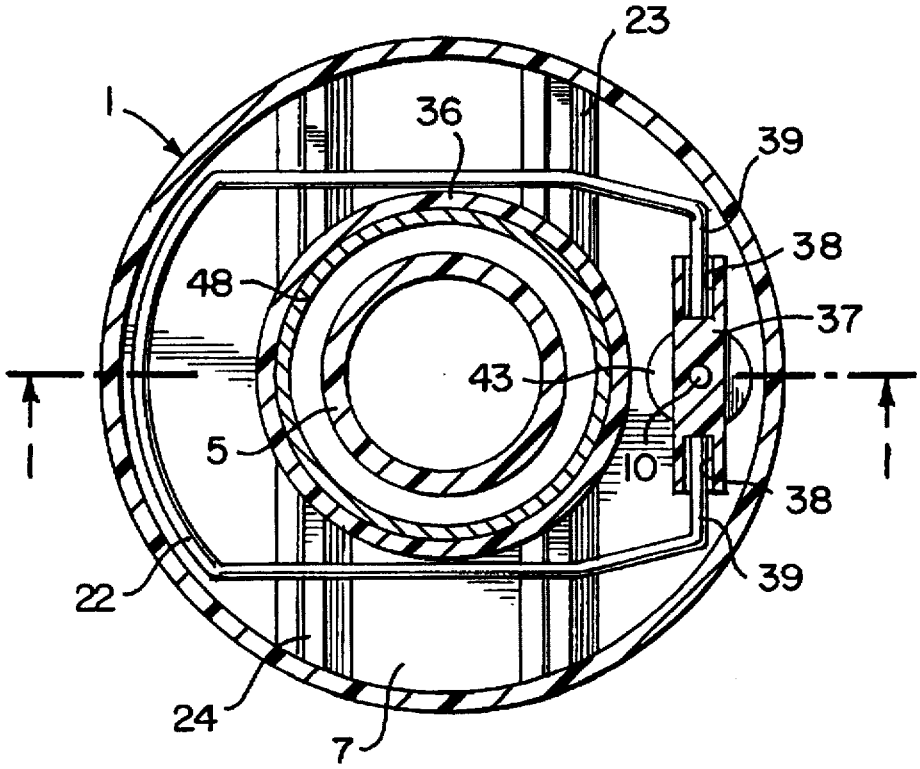

APPARATUS FOR REGULATING THE QUANTITY OF LIQUID FOR THE FLUSHING OF TOILET BOWLS

This is a continuation, of application Ser. No. 08/618,417, filed Mar. 15, 1996, which is now abandoned and which is a continuation of application Ser. No. 08/350,517, filed Dec. 6, 1994, which is now abandoned and which is a continuation of application Ser. No 07/907,972, filed Jul. 2, 1992 which is now abandoned.

BACKGROUND OF THE INVENTION

The invention relates to toilets with flushing tanks, and more particularly to improvements in apparatus for initiating and terminating the flow of water or another flushing liquid from a tank into a toilet bowl.

It is known to provide a water closet with a float which can descend with a body of liquid to control the movement of a valving element which seals the outlet of a flushing tank when the latter has discharged a predetermined quantity of liquid into a toilet bowl. Thus, once the valving element has been lifted off the outlet of the tank, the evacuation of flushing liquid proceeds until terminated by the float which descends at a controlled rate in order to lower the valving element back into sealing engagement with a seat at the outlet of the tank. To this end, the tank or another part of the water closet carries a knob, a lever or another actuator which must be operated (e.g., pulled, pushed or pivoted) by hand in order to disengage the valving element from the outlet of the tank. The float can be installed in a separate housing whose internal chamber communicates with the internal space of the tank so that the liquid in the housing descends at the same rate as the liquid in the tank. The liquid which flows into the tank during or subsequent to flushing of the bowl fills the tank and the housing to a predetermined level, and the apparatus is then ready for the next flushing operation.

It is further known to select the quantity of liquid which is discharged into a toilet bowl in response to disengagement of the valving element from its seat at the outlet of the flushing tank. Thus, the flushing operation can be terminated before the tank is empty, i.e., it is possible to select a relatively small quantity of liquid which is deemed to be sufficient for effective flushing of the toilet bowl. A drawback of such conventional apparatus is that they are not sufficiently versatile, i.e., they can be operated to discharge a full quantity or a relatively small quantity of liquid but it is not possible to select another quantity prior to start of or in the course of a flushing operation. Insufficient flushing can result in the accumulation of waste in the pipe or pipes connecting the bowl with the waste discharge system. The accumulations can reach proportions which render the toilet useless for its intended purpose. On the other hand, it is desirable and advantageous for ecological reasons and for reasons of economy to limit the quantities of flushing liquid to a minimum. This would render it possible to operate with more compact sewage disposal systems as well as to achieve substantial savings in flushing liquid.

OBJECTS OF THE INVENTION

An object of the invention is to provide a novel and improved apparatus which can be combined with or incorporated into a water closet to regulate the quantities of flushing liquid within a desired range.

Another object of the invention is to provide a novel and improved apparatus for controlling the quantities of flushing liquid which are to be discharged from the tank of a toilet.

A further object of the invention is to provide a versatile apparatus which can be designed to regulate the quantities of flushing liquid within a wide range.

An additional object of the invention is to provide the apparatus with novel and improved means for interrupting the flow of flushing liquid from a tank into a toilet bowl.

Still another object of the invention is to provide an apparatus which can be installed in or combined with the flushing tanks of existing water closets.

A further object of the invention is to provide a novel and improved method of economizing with liquid which is used to flush toilet bowls.

An additional object of the invention is to provide a method of interrupting the outflow of liquid from the flushing tank of a toilet prior to evacuation of the entire contents of the tank.

SUMMARY OF THE INVENTION

The invention is embodied in an apparatus for flushing a toilet bowl. The improved apparatus comprises a tank having a liquid confining space and an outlet for admission of liquid into the toilet bowl, a housing (which can be installed in the tank) having a chamber and an opening connecting the chamber with the space of the tank, a float which is provided in the chamber and is arranged to rise or descend in response to flow of liquid into or from the chamber, an actuator which extends through the housing and includes a valving element and is movable to and from an operative position in which the valving element seals the outlet to prevent the flow of liquid from the space into the bowl, and novel and improved means for regulating the movements of the actuator to interrupt the flow of liquid from the tank into the toilet bowl upon evacuation of a preferably variable predetermined minimum quantity of liquid through the outlet of the tank.

In accordance with a presently preferred embodiment, the regulating means comprises a valve which is displaceable relative to the housing to and from a predetermined position in which the opening of the housing is nearly sealed to limit the flow of liquid between the space and the chamber, and means for displacing the valve. The valve can comprise a substantially disc-shaped sealing element.

The regulating means can further comprise means for locating (e.g., centering) the displacing means and the valve relative to the housing and the opening in the housing. Such locating means can comprise a first portion at a level above and a second portion at a level below the valve.

If the valve is displaceable substantially vertically, the displacing means can comprise means for moving the value from the predetermined position to a level above and to a level below the opening.

The regulating means can further comprise means for biasing the displacing means to at least one predetermined position relative to the housing. If the displacing means is movable along a substantially vertical path, it can comprise a portion which is disposed beneath the valve and the biasing means can comprise a spring (e.g., a coil spring) which reacts against the housing (and/or against another stationary part) and bears against the portion of the displacing means to urge the latter downwardly. The housing can comprise a fixed retainer for the spring. It is also possible to employ biasing means having a spring which reacts against the housing and/or against another stationary part and bears against a portion of the displacing means above the valve to urge the valve upwardly.

The float can be provided with a passage, and the displacing means can be mounted for reciprocatory movement in the passage. Such float can be provided with a reinforcing lining which surrounds the passage.

The apparatus can further comprise a jacket or envelope which surrounds a portion of or the entire float.

Means can be provided to couple the float with the displacing means of the regulating means; such coupling means can comprise a yoke Which is provided in the housing and includes a first portion at the float, a second portion and means for preferably articulately connecting the second portion of the yoke to the displacing means. A bottom wall of the housing can be provided with or can be adjacent to at least one fulcrum which serves to tilt the yoke in response to movement of the float in the chamber. Such at least one fulcrum can be positioned to tilt the yoke in response to a rise of the float in the chamber and/or to tilt the yoke in response to a descent of the float in the housing.

At least a portion of the actuator can constitute a tube.

The apparatus can further comprise means for mechanically coupling the actuator with the displacing means. The mechanical coupling means can comprise a transverse brace which is provided on the displacing means. Such apparatus can further comprise means for depressing the displacing means by way of the actuator and/or by way of the float and the coupling means. The latter can further comprise a lever (e.g., in the form of a yoke) which is articulately connected to the brace.

The apparatus can also comprise means (e.g., one or more coil springs and/or one or more leaf springs) for biasing the displacing means to a predetermined starting position.

The displacing means can include means for moving the valve between the predetermined position and a plurality of additional positions in each of which the opening permits the liquid to flow between the chamber and the space at a different rate.

The housing can include or can carry a collar which surrounds the opening and defines with the valve a clearance for the flow of liquid between the chamber and the space.

The apparatus can comprise means for mechanically coupling the actuator with the displacing means. Such coupling means can comprise a lever (such as the aforementioned yoke) and at least one wear-resistant member between the lever and the float.

The apparatus can also comprise means for adjusting the actuator relative to the housing and relative to the float. Such adjusting means can comprise at least one female adjusting element (e.g., one or more circumferential recesses or grooves in the peripheral surface of the actuator) and at least one male adjusting element (e.g., a substantially washer-like arresting member which extends into a selected recess or groove, and means (e.g., a split ring or an O-ring) for releasably holding the arresting member in the selected recess or groove).

The tank can comprise an upright tubular adapter, and the housing can include a wall (e.g., a cylindrical internal wall) which surrounds the adapter. The latter surrounds the actuator which is reciprocable therein. Means can be provided for adjustably connecting the housing with the adapter. For example, such connecting means can comprise a length of wire which couples the actuator with the wall of the housing.

The apparatus also comprises means for filling the space of the flushing tank with liquid to a predetermined level, and the top wall of the housing can be disposed below such level.

The apparatus can further comprise means for operating the actuator and the displacing means. Such operating means can comprise a knob or a like part which serves to push or pull the actuator. The operating means can be manipulated by hand to initiate the flow of a predetermined maximum quantity of liquid from the space in the tank, through the outlet of the tank has a result of disengagement of the valving element from the outlet) and into the toilet bowl. The operating means can further include or constitute means for effecting an interruption of the flow of liquid from the space prior to evacuation of the full predetermined (maximum) quantity of liquid. For example, the operating means can be arranged to be manipulated by hand to disengage the valving element from the outlet or vice versa in response to a first manipulation and to interrupt the flow of liquid into the toilet bowl, prior to emptying of the tank, in response to a second manipulation. The first manipulation can involve the application of a first pulling or pushing force, and the second manipulation can involve the application of a greater second pulling or pushing force.

The operating means can further include means for restoring the flow of liquid from the space within the flushing tank in order to evacuate additional liquid from the tank. The arrangement may be such that the operating means is responsive to a first push or pull to initiate the flow of the predetermined quantity of liquid into the toilet bowl, and to a second push or pull in order to interrupt the flow of liquid into the toilet bowl prior to evacuation of the predetermined quantity from the tank.

The housing can be provided with a second opening (hereinafter called aperture) which connects the chamber of the housing with the space in the flushing tank, and the regulating means then further comprises a second valve which is movable between a plurality of positions relative to the aperture, and means (e.g., an elongated bar) for moving the second valve in response to the movement of the displacing means. The second valve can constitute a magnetic valve which preferably comprises a buoyant member in the chamber of the housing, a magnet which is coupled to the buoyant member, and a magnetizable (e.g., ferromagnetic) member which is disposed at the aperture and serves to attract the magnet to thereby seal the aperture when the magnet is lowered sufficiently close to the magnetizable member to overcome the tendency of the buoyant member to lift the magnet above and away from the magnetizable member. The latter is preferably configurated to permit at least some liquid to flow through the aperture, i.e., the magnetizable member can seal the aperture only in conjunction with the magnet when the latter is sufficiently close to and is attracted by the magnetizable member to assume a sealing position.

The means for moving the second valve can comprise means for biasing the magnet toward the magnetizable member. Such moving means can further comprise an operating device having means for moving the magnet away from the magnetizable member. The operating device can extend downwardly through the buoyant member, through the magnet, through the aperture and through the magnetizable member. The means for moving the magnet away from the magnetizable member when the buoyant member is free to rise in the chamber of the housing, or when the operating device is pulled to lift the buoyant member and the magnet, can comprise an enlarged portion of the operating means.

The just discussed apparatus can further comprise means for adjustably connecting the operating means with the displacing means. The displacing means can include or constitute an elongated rod, and the connecting means can be designed in such a way that it is movable longitudinally of the rod. Means (e.g., one or more legs or similar portions of the connecting means) can be provided for maintaining the connecting means in a selected position relative to the displacing means. For example, the connecting means can comprise a yoke defining with the displacing means a clearance for a portion of the operating means.

The apparatus comprises means for supplying liquid into the tank, and the actuator can be provided with an inlet which is disposed at a predetermined level in the tank to receive liquid when the liquid in the tank rises to this level. The actuator defines a passage for the flow of liquid from the inlet into the toilet bowl. Such apparatus preferably further comprises means for adjusting the level of the inlet in the space of the tank so as to determine the maximum quantity of liquid which can gather in the tank.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawings.

BRIEF DESCRIPTION OF THE DRAWINGS

FIG. 4 is a fragmentary elevational view showing one mode of adjusting the level of the actuator;

FIG. 5 is a horizontal sectional view substantially as seen in the direction of arrows from the line V—V in FIG: 3;

Figure 9:
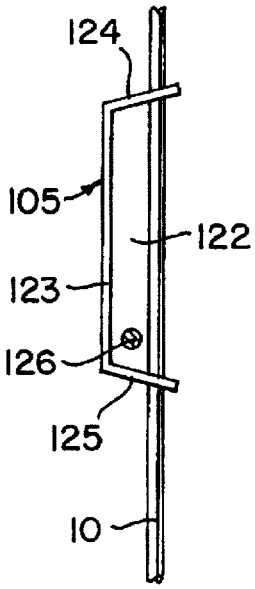
Figure 10:
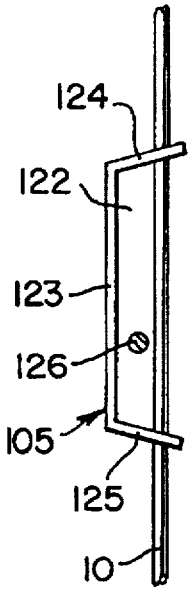
Figure 8:
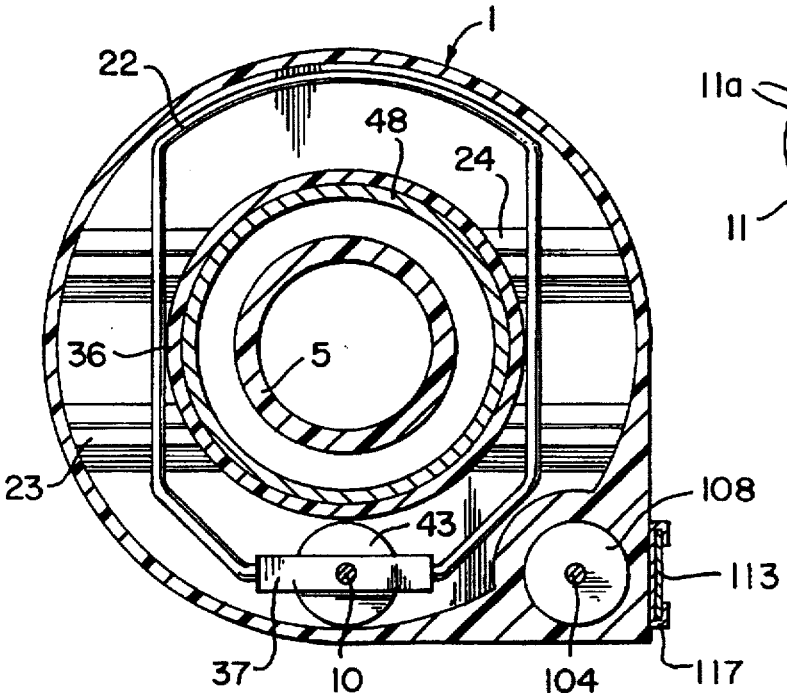
Figure 7:
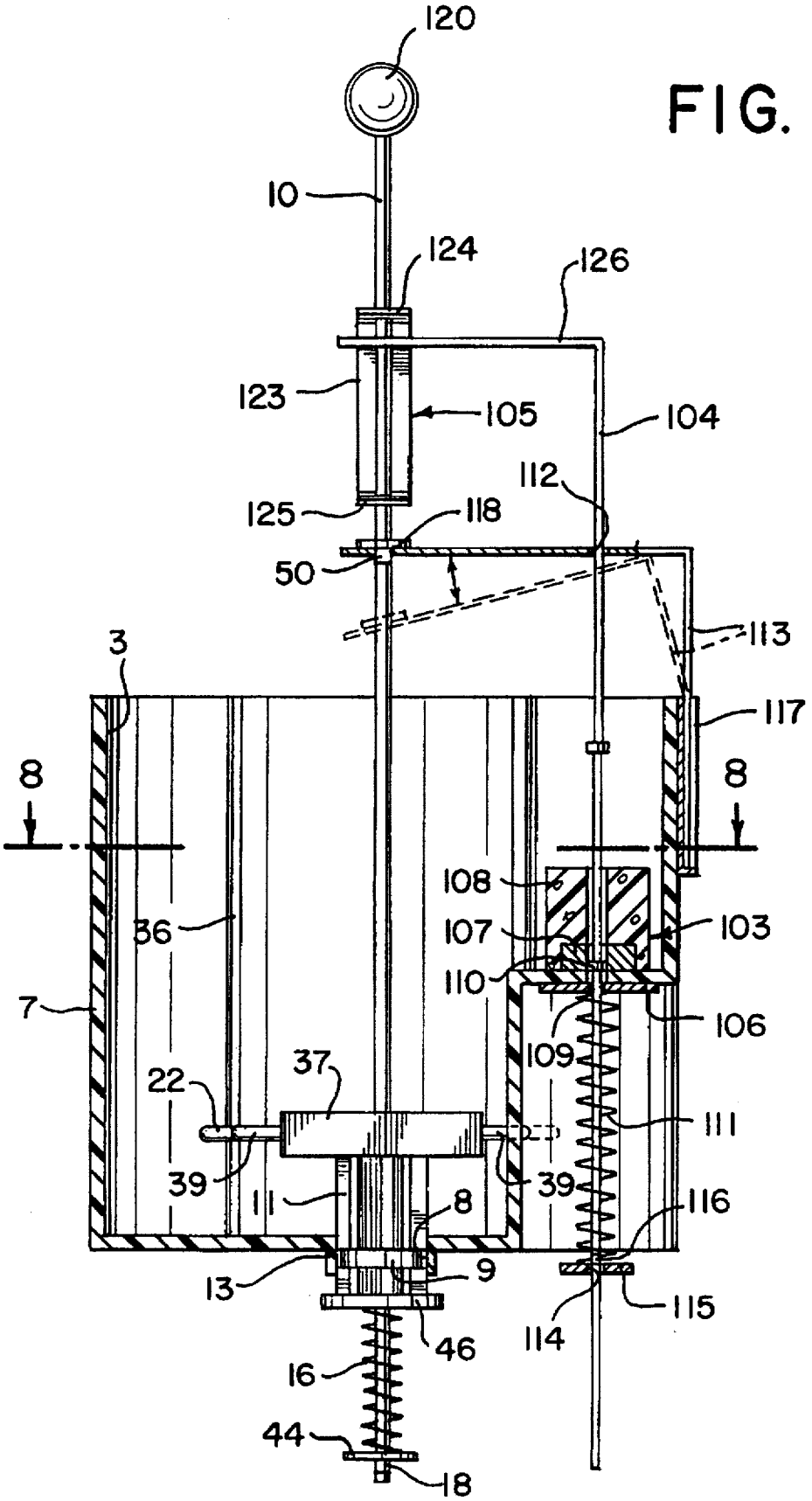

PIG. 6 illustrates a presently preferred coupling between an adapter and an internal wall of the housing;

FIG. 7 is a fragmentary schematic partly elevational and partly vertical sectional view of a modified apparatus wherein the displacing member of the regulating means can transmit motion to certain parts of a further valve in a wall of the housing within the flushing tank;

FIG. 8 is a schematic horizontal sectional view substantially as seen in the direction of arrows from the line VIII—VIII in FIG. 7;

FIG. 9 illustrates a portion of the apparatus of FIG. 7 with an adjusting means in a different position; and FIG. 10 illustrates the structure of FIG. 9 but with the adjusting means in a further position.

Figure 11:
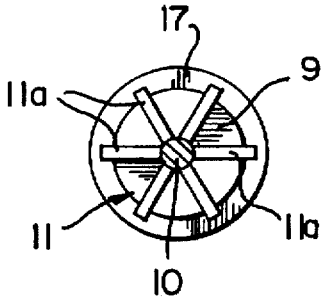

FIG. 11 is a view of a valve taken through the operating rod looking upwardly.

DESCRIPTION OF PREFERRED EMBODIMENTS

FIGS. 1 to 5 illustrate a first embodiment of the improved toilet flushing apparatus. The apparatus comprises a flushing tank 34 having an internal space 134 for a supply of flushing liquid (such as water and hereinafter called water for the sake of brevity), an upright (preferably cylindrical) housing 1 which is installed in the tank 34, a float 4 which is reciprocable in an internal chamber 3 of the housing 1 and whose axis preferably coincides with the vertical axis 2 of the housing, and an at least partially tubular actuator 5 which extends through the housing 1 and through a central hole 15 of the float. The tank 34 includes an insert 27 which is threadedly connected to its bottom wall and has an annular seat 33 surrounding an outlet 32 for evacuation of selected quantities of water from the chamber 134 into a toilet bowl (not shown). Reference may be had, for example, to commonly owned U.S. Pat. No. 5,123,125 granted Jun. 23, 1992 for "Flushing tank for use with toilet bowls".

The lower end portion of the actuator 5 carries a plate-like valving element 6 which can descend into sealing engagement with the seat 33 to thereby seal the outlet 32 and to thus interrupt or terminate the flow of water into the toilet bowl.

The bottom wall 7 of the housing 1 is provided with a preferably circular opening 8 which establishes communication between the internal space 134 of the tank 34 and the chamber 3 of the housing 1 when a disc-shaped sealing element or valve 9 is maintained at a level above or below the bottom wall 7. The valve 9 forms part of a unit which serves to regulate the movements of the actuator 5 in order to determine the quantity of water which is permitted to leave the space 134 through the outlet 32 in order to flush the toilet bowl. The regulating unit further comprises an elongated upright displacing member 10 (hereinafter called rod for short) whose central vertical axis 12 coincides with the axes of the valve 9 and opening 8. The valve 9 is carried by and is movable with the rod 10 to a level above (FIG. 2), to a level below (FIG. 1) or to a partial sealing position (FIG. 3) in the opening 8 of the bottom wall 7. The rod 10 further carries a radially and axially extending locating device or cage 11 having portions disposed above and below the valve 9. The locating device 11 cooperates with a cellar 13 which is located below the opening 8 and extends downwardly from the bottom wall 7 of the housing 1 to center the rod 10 and the valve 9 relative to the opening 8. Each of the two portions of the locating device 11 can comprise a substantially star-shaped array of parts (e.g., prongs) which are carried by the rod 10. A stop 46 on the lower portion of the locating device 11 serves as a means for limiting the extent of downward movability of the valve 9 relative to the bottom wall 7 of the housing 1. The stop 46 can engage the top panel or wall 29 of the aforementioned insert 27 which includes the seat 33 and defines the outlet 32 of the tank 34. The collar 13 constitutes an optional but desirable feature of the regulating unit; its purpose is to cooperate with the locating device 11 to reliably guide the valve 9 and the rod 10 for movement relative to the housing 1 and float 4 in the chamber 3. The central vertical axis of the collar 13 preferably coincides with the axis 12 of the rod 10.

The float 4 is provided with a vertical passage 14 to reciprocably receive an elongated portion of the rod 10 at a level above the bottom wall 7 and the valve 9. It is presently preferred to provide the float 4 with a reinforcing lining **14*a* which surrounds the passage 14 and serves to reduce the wear upon the float as a result of repeated movements of the rod 10 and valve 9 relative to the housing and the float. For example, the lining 14*a* can constitute a continuous tube or it can consist of a series of axially aligned short tubes or sleeves which surround certain portions of or the entire passage 14**.

The float 4 can constitute a hollow upright cylinder which is reciprocably received in the chamber 3 of the housing 1.

Such design reduces the likelihood of jamming of the float 4 in response to admission of water into or in response to evacuation of water from the chamber 3 through the opening 8 in the bottom wall 7. A median portion of the actuator 5 extends with clearance through the central vertical hole 15 of the float 4. In order to further reduce the likelihood of jamming of the float 4 in the chamber 3, the housing 1 is preferably provided with a cylindrical internal wall 36 which extends with requisite clearance between the internal surface of the float and the external surface of the actuator 5. Jamming of the float 4 is further prevented by the rod 10 which is reciprocably guided in the top wall 7*a* of the housing 1 and whose locating device 11 is reciprocably guided in the collar 13 of the bottom wall 7.

The regulating unit further comprises means for biasing the rod 10 to certain positions relative to the housing 1 in order to select corresponding positions of the valve 9. The illustrated biasing means comprises a coil spring 16 at a level below the valve 9. The spring 16 facilitates the assembly of the regulating unit because it renders it possible to simply slip the valve 9, the locating device 11, the stop 46, a retainer 17 and a retainer 44 loosely onto the rod 10 and to thereupon maintain such parts in proper positions solely in cooperation with a portion or abutment 18 of the rod 10 and a transverse brace 37 (FIG. 5). The uppermost convolution of the spring 16 (which surrounds the rod 10 beneath the valve 9) reacts against the retainer 17 at the lower end of the locating device 11, and the lowermost convolution of this spring reacts (directly or indirectly) against the aforementioned portion or abutment 18 of the rod 10.

The biasing means further comprises an (optional) second coil spring 19 which reacts against a portion or abutment 21 on the upper part of the rod 10 at a level above the top wall 7*a* of the housing 1 and bears against a retainer 20 at the upper side of the top wall 7*a*. The spring 19 can be utilized in conjunction with or in lieu of the spring 16. If the spring 16 is omitted, the illustrated locating device 11 is preferably replaced with a longer locating device (as seen in the direction of the axis 12 of the rod 10). The retainer 20 can form part of the top wall 7*a* of the housing 1.

Figure 2:
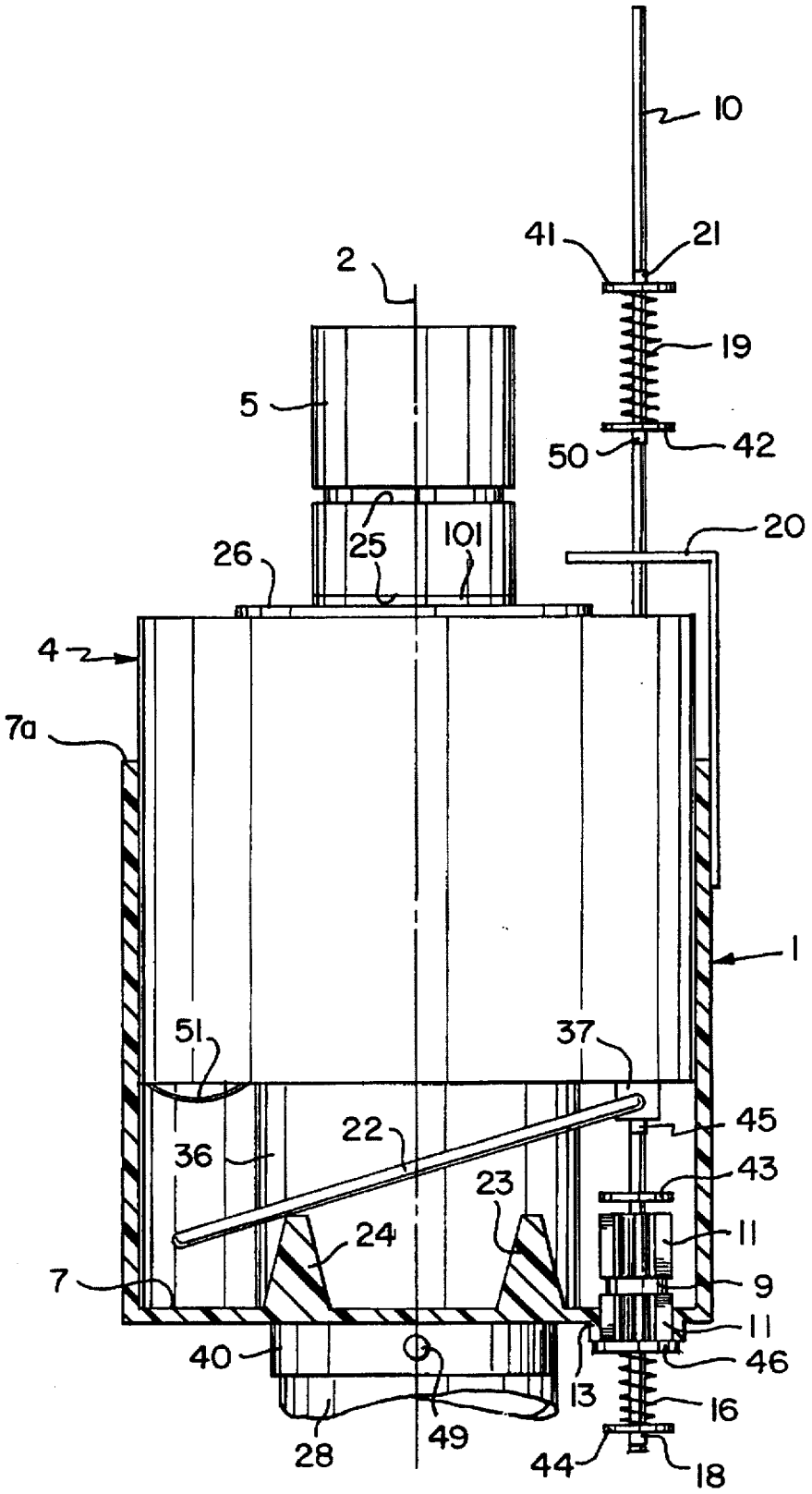
FIG. 2 illustrates a portion of the structure of FIG. 1, with the regulating means in raised position so that the valve of the regulating means is located in the chamber of the housing.
Figure 3:
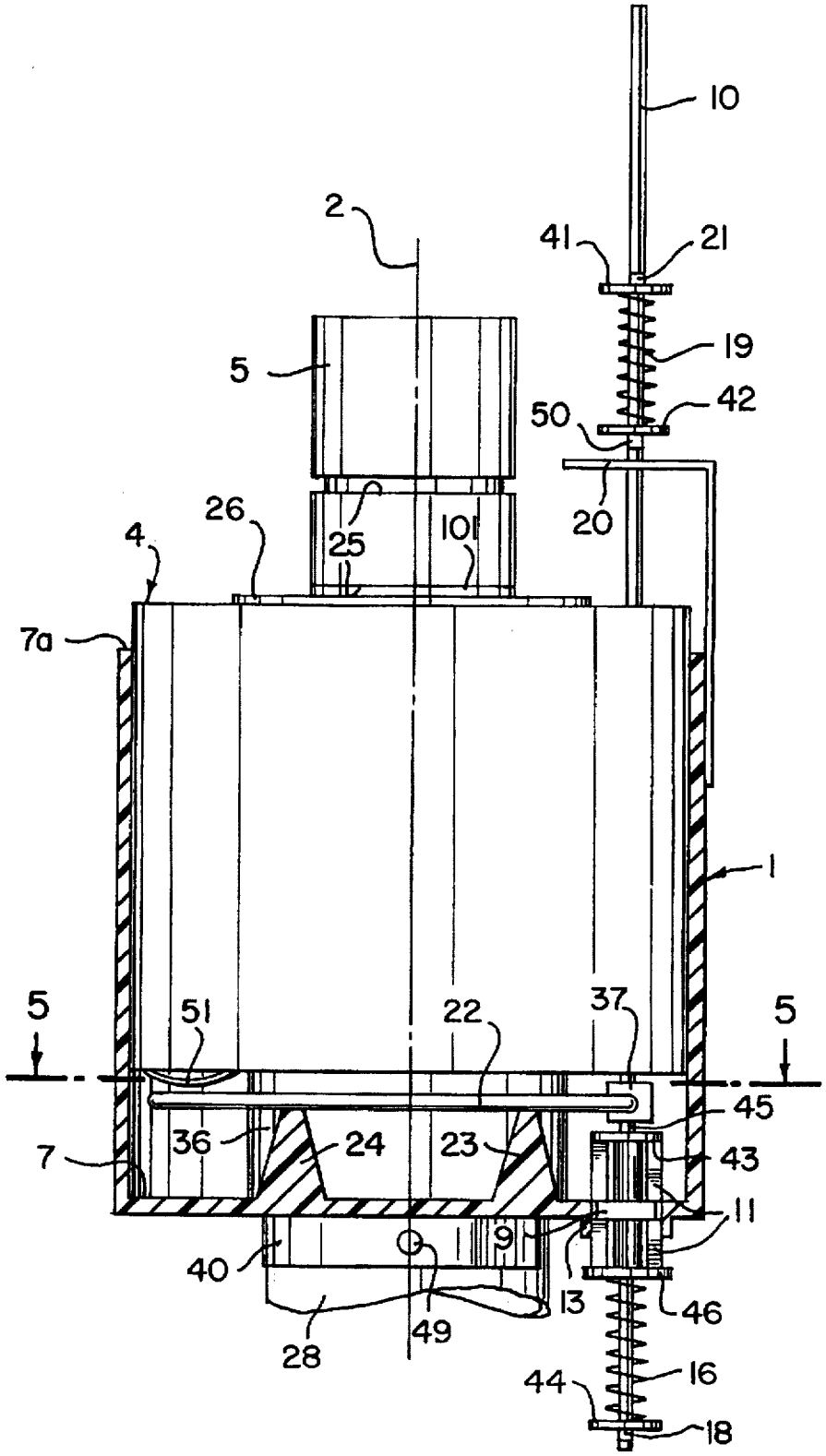
FIG. 3 shows the structure of FIG. 2 but with the regulating means in an intermediate position in which the valve nearly seals the opening in the bottom wall of the housing.

FIG. 2 shows that the rod 10 carries a first disc-shaped retainer 41 which is disposed between the portion or abutment 21 and the uppermost convolution of the spring 19, and a second disc-shaped retainer 42 between the lowermost convolution of the spring 19 and a further portion or abutment 50 of the rod 10 beneath the portion or abutment 21. The convolutions of the spring 19 surround the rod 10 between the retainers 41, 42, and the convolutions of the spring 16 surround the rod 10 between the retainer 17 and the disc-shaped retainer 44 above the portion or abutment 18 of the rod. An additional disc-shaped retainer 43 is disposed beneath a rod portion or abutment 45 above the locating device 11.

The abutment or portion 50 on the upper part of the rod 10 is configurated and dimensioned in such a way that it can pass through a suitably shaped and dimensioned opening of the retainer 20 but not through the disc 42 at the lower end of the coil spring 19.

FIGS. 7 and 8 show that the biasing means including the coil spring 16 and/or 19 can be replaced with a biasing means employing a leaf spring 113 having an upright lower leg which extends into a vertical guide 117 at the exterior of the housing 1 and a horizontal leg which has a bore or hole 118 for the rod 10. The portion or abutment 50 on the upper part of the rod 10 is located above and can engage the horizontal leg of the leaf spring 113. The configuration of the leaf spring 113 is such that it does not apply forces to the rod 10 irrespective of whether the rod is held in the upper or in the lower end position relative to the housing 1. Thus, the leaf spring 113 is preferably constructed, configurated and mounted to avoid any lateral deflection of the rod 10.

In order to ensure that the valve 9 can be maintained in a predetermined starting position, the regulating unit further comprises a coupling device including a one-armed lever here shown as a yoke 22 a portion of which is articulately connected to the rod 10, namely to the aforementioned brace 37 which is shown in FIG. 5 and extends transversely of the corresponding portion of the rod 10. In order to transmit forces from the yoke 22 to the rod 10, the upper side of the bottom wall 7 of the housing 1 is provided with or connected to two upwardly extending fulcra 23, 24 each of which pivots the yoke while the float 4 descends in the chamber 3 of the housing 1. The fulcrum 23 pivots the yoke 22 if the float 4 descends before the valve 9 has ascended into the opening 8, and the yoke 22 is pivoted by the fulcrum 24 if the float 4 descends while the valve 9 nearly seals the opening 8.

At least the upper portion of the actuator 5 is provided with circumferentially extending external recesses or grooves 25 each of which can receive a substantially washer-like arresting member 26. The member 26 can be releasably held in a selected recess 25 by a split ring 101 or in any other suitable way. The arresting member 26 can come to rest on top of the float 4 in order to prevent further downward movement of the actuator relative to the float. The position of the arresting member 26 relative to the actuator 5 determines the quantity of water which can escape from the space 134 through the outlet 32 and into a toilet bowl in response to lifting of the actuator in order to start a flushing operation. The quantity of water which is permitted to flow into the toilet howl is reduced if the arresting member 26 is installed in a recess 25 which is nearer to the top of the actuator 5. If the arresting member 26 is installed nearer to the valving element 6 at the lower end of the actuator 5, the valving element requires a longer interval of time to descend back into sealing engagement with the seat 33 around the outlet 32. The washer-like arresting member 26 can be made of a suitable plastic material. The split ring 101 can be replaced with a deformable O-ring which can be affixed to the arresting member 26 to snap into a selected recess 25 and to thus retain the member 26 in such recess at a selected distance from the valving element 6.

The recesses 25 weaken the corresponding portions of the actuator 5. Thus, the actuator 5 can be shortened by severing or breaking it at the level of a selected recess 25 in order to reduce its overall size for convenient installation in a particular water closet. For example, the actuator 5 can be severed at the level of a selected recess 25 if it is to be installed in a toilet having a relatively short flushing tank.

The insert 27 of the tank 34 has an external thread which surrounds the seat 33 and meshes with a complementary thread in the bottom wall of the tank 34. This insert is located at a level beneath the bottom wall 7 of the housing 1 and is secured to the latter by a connecting or coupling device 28 in the form of an upright cylinder which surrounds the adjacent portion of the actuator 5. The latter extends through a central opening in the top panel 29 of the insert 27. In the sealing position which is shown in the right-hand portion of FIG. 1, the valving element 6 is disposed between the upper panel 29 and a lower wall or panel 30 which carries the seat 33. The panels 29, 30 are connected to each other by substantially vertically extending ribs 31 which establish clearances for the flow of water from the main portion of the space 134 into the outlet 32 when the actuator 5 has been lifted to maintain its valving element 6 at a level above the seat 33 of the insert 27. The panels 29, 30 of the illustrated insert 27 are parallel to each other and to the bottom wall 7 of the housing 1. The seat 33 may but need not constitute a relatively short cylinder whose axis coincides with the common axis 2 of the housing 1 and actuator 5. A nut (not shown) can be provided beneath the bottom wall of the tank 34 to mate with the lower portion of the external thread on the seat 33 and to thus deform an elastomeric sealing ring 33*a* into sealing engagement with the underside of the panel 30 as well as with the upper side of the bottom wall of the tank 34.

Figure 1:
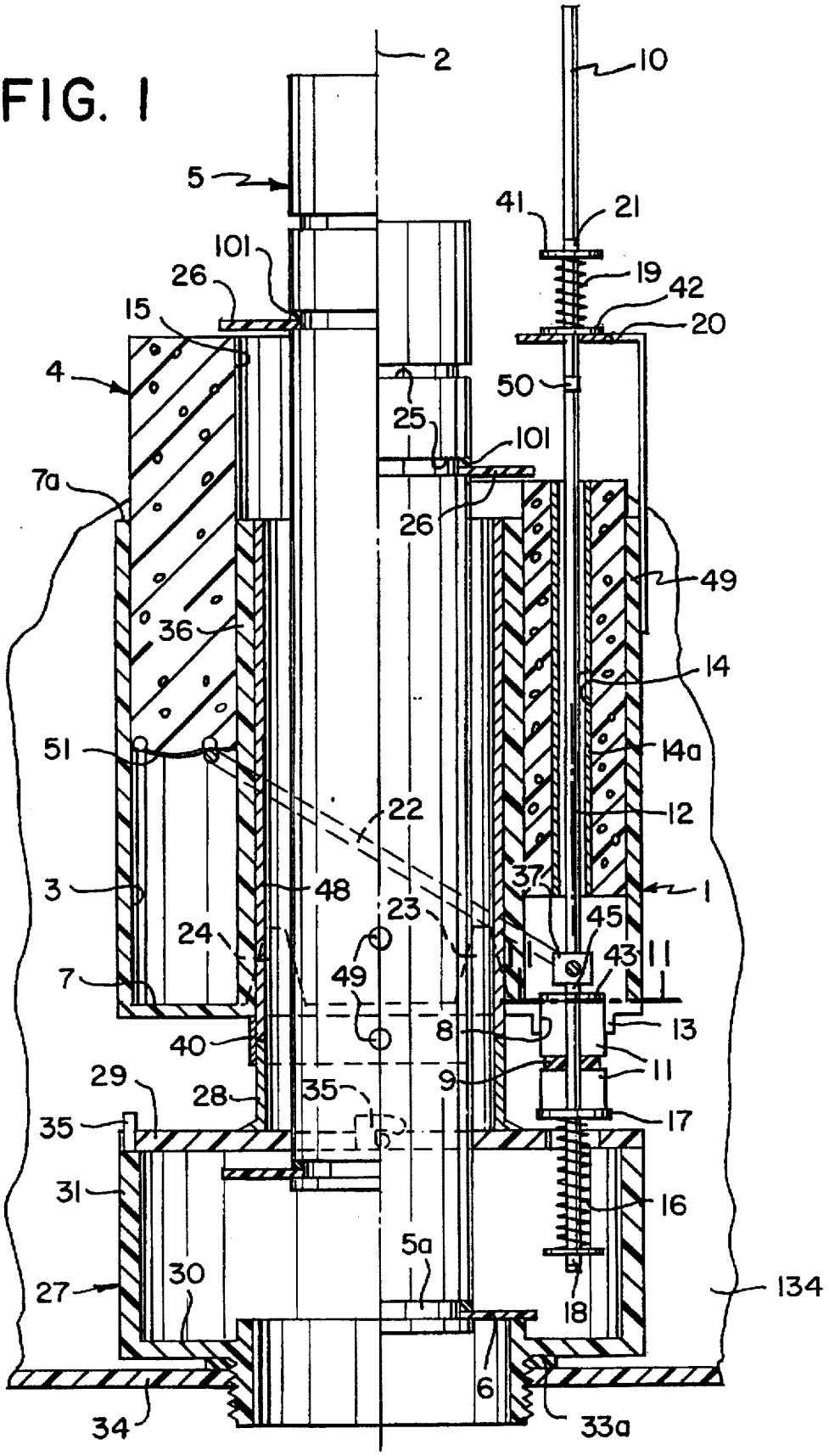
FIG. 1 is a fragmentary schematic partly elevational and partly vertical sectional view of an apparatus which embodies one form of the invention, the left-hand portion of the valving element on the actuator being shown in a raised position above the outlet of the flushing tank and the right-hand portion of the valving element being shown in the predetermined position, the section of FIG. 1 being taken in the direction of arrows as seen from the line I—I in FIG. 5.

The valving element 6 can comprise or constitute a disc of rubber or other suitable elastomeric material which extends into a circumferential groove 5*a* at the lower end of the actuator 5 and sealingly engages the top face of the seat 33 when the actuator 5 is free to descend to the lower end position which is shown in the right-hand portion of FIG. 1. The top panel 29 of the insert 27 can be releasably connected to the lower end of the connecting or coupling cylinder 28 by a bayonet mount 35. Other suitable mechanical connections between the parts 27 and 28 can be utilized with equal or similar advantage.

Figure 6:
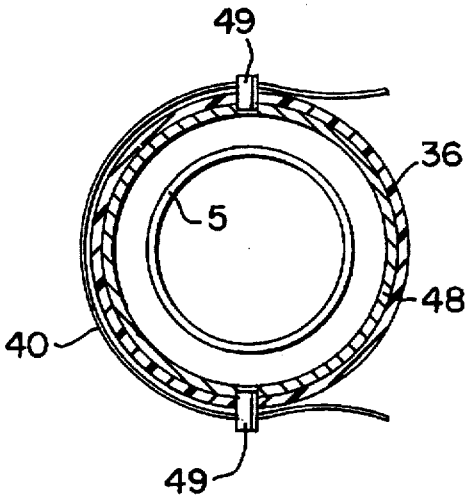

The internal wall 36 of the housing 1 is preferably a cylinder which rather snugly receives the adjacent portion of the preferably tubular or partly tubular actuator 5. The clearance between the cylindrical internal wall 36 and the preferably cylindrical actuator 5 suffices to ensure that the actuator can move up and down relative to the housing 1. The chamber 3 surrounds the internal wall 36 of the housing 1, and the aforementioned clearance can be selected by utilizing a cylindrical adapter 48 which can be inserted between the actuator and the internal wall 36. The adapter 48 is preferably adjustable relative to the internal wall 36 in the direction of the axis 2. The lower end of the adapter 48 is or can be secured to the insert 27 so that, by selecting the axial position of the adapter 48 relative to the internal wall 36, one can select the distance of the insert 27 from the bottom wall 7 of the housing 1. The connecting cylinder 28 can constitute the lower end portion of the adapter 48; as mentioned above, the cylinder 28 is secured to the top panel 29 of the insert 27. A presently preferred mode of releasably coupling the adapter 48 to the internal wall 36 of the housing 1 is shown in FIG. 6. The coupling comprises radially extending sleeves or eyelets 49 which are provided in the wall 36 and are receivable in complementary sockets or holes of the adapter 48, and a length of wire 40 which is threaded through the sleeves or eyelets 49. Other types of means for releasably coupling the adapter 48 to the internal wall 36 of the housing 1 can be used with equal or similar advantage. The actuator 5 is reciprocable relative to the adapter 48.

FIG. 5 shows that the brace 37 extends transversely of the rod 10 and its two end portions have sockets 38 for suitably bent prong- or pin-shaped portions 39 of the yoke 22. Such articulate connection constitutes but one of the means which can be utilized to movably (pivotably) secure the rod 10 and its brace 37 to the adjacent portion of the yoke 22. For example, the brace 37 can be provided with pins (corresponding to the portions 39) which are receivable in sockets (corresponding to those shown at 38) in the adjacent portion of the yoke 22. The brace 37 can constitute a tube which is traversed by the rod 10 between the sockets 38.

The reference character 51 denotes in FIG. 1 a piece of wire which is affixed to the underside of the cylindrical float 4 and abuts the adjacent free end portion of the yoke 22 diametrically opposite the pin-shaped portions 39. This wire reduces the likelihood of extensive wear upon the adjacent portion of the yoke 22- and/or upon the float 4 when the latter descends and causes the yoke to pivot relative to the fulcrum 23 or 24 at the upper side of the bottom wall 7 of the housing 1. The illustrated wire 51 can be replaced with a wear-resistant or wear-reducing plate or with any other part which can perform the aforediscussed function of the wire 51. The manner in which the yoke 22 can raise the rod 10 and the valve 9 or permits a lowering of the rod 10 and the valve 9 in response to raising or lowering of the float 4 can be understood by comparing the angular positions of the yoke 22 in FIGS. 1, 2 and 3. The valve 9 defines with the collar 13 a clearance even if the rod 10 assumes the axial position of FIG. 3.

The upper end of the actuator 5 is provided with a knob or the like (not shown) to permit lifting of the actuator in order to initiate a flushing operation which involves the evacuation of a maximum quantity of water from the tank 34. The rod 10 is moved axially by a knob or the like if the quantity of flushing water is to be reduced below such maximum quantity.

When the apparatus is not in use, the tank 34 is filled with water to a level above the top wall 7*a* of the housing 1 or at least above the opening 8. This ensures that, when the actuator 5 is lifted (e.g., by hand) in order to initiate a flushing operation, adequate quantities of water can flow from the space 134 into the chamber 3 to lift the float 4 toward the top wall 7*a* of the housing 1. When the user of the toilet lifts the actuator 5 (e.g., by the knob at the upper end of the actuator), the valving element 6 is lifted above and away from the seat 33 of the insert 27 so that water which was confined in the space 134 of the tank 34 can flow between the ribs 31 of the insert 27, into the outlet 32 and thence into the toilet bowl. The arrangement is preferably such that the float 4 cannot, by itself, lift the valving element 6 of the actuator 5 off the seat 33. However, once the actuator 5 has been lifted by hand or otherwise and the float 4 was permitted to rise in the chamber 3 due to its buoyancy, the float begins to descend as the upper level of the supply of water in the space 134 descends whereby the valving element 6 moves downwardly (at a speed which is determined by the descending float 4) toward and ultimately into sealing engagement with the seat 33 to thus prevent further flow of water from the space 134, through the outlet 32 and into the toilet bowl. The valve 9 is then located above or below or in the opening 8 so that the latter permits water to flow at a selected rate between the chamber 3 and the space 134, i.e., the liquid level in the chamber 3 descends proportionally with the selected rate of water flow between the housing 1 and the tank 34. In order to terminate or interrupt the outflow of water from the tank 34 into the toilet bowl, the rod 10 is used to displace the valve 9 relative to the bottom wall 7 of the housing 1 so as to increase the exposed area of the opening 8 and to thus enable water to flow from the chamber 3 at a higher rate so that the throttling action of the valve 9 is reduced and the descent of the float 4 and actuator 5 relative to the housing 1 and insert 27 is accelerated. In other words, the float 4 and the actuator 5 descend more rapidly than when the valve 9 cooperates with the collar 13 to furnish a pronounced throttling action and to thus compel the float 4 to descend in the chamber 3 at a relatively low speed.

An interruption of the outflow of water from the tank 34 into the toilet bowl is possible when the level of water in the space 134 has descended to an extent which is necessary to enable the float 4 to descend to a level at which the valving element 6 at the lower end of the actuator 5 (which descends with the float) is free to reengage the seat 33 and to thus seal the outlet 32 of the tank 34. Thus, the regulating action can begin when a predetermined minimal quantity of water has been permitted to leave the space 134 by flowing into the toilet bowl. Before the outflow of such minimal quantity of water from the space 134 is completed, the opening 8 merely serves to permit the flow of water between the space 134 and the chamber 3 in order to ensure that the upper level of water in the housing 1 matches the upper level of water in the tank 34. The outflow of water through the outlet 32 continues until the float 4 permits the actuator 5 to descend to the level which is necessary to return the valving element 6 into sealing engagement with the seat 33. The minimum quantity of water which is permitted to leave the tank 34 is determined by appropriate selection of the level of the housing 1 (and hence of the float 4) relative to the seat 33. Thus, by adjusting the connection 40, 49 of FIG. 6, it is possible to select a different minimum quantity of water which must be discharged from the space 134 before the valving element 6 can reach and again seal the outlet 32. Such adjustability of the level of the housing 1 relative to the tank 34 enables the person in charge to conform the minimum quantity to any one of a variety of parameters, e.g., to the capacity of the tank 34 and to the estimated minimum quantity of water which is needed to effectively flush the toilet bowl. Furthermore, the minimum quantity of water which is permitted to leave the tank 34 can be determined in advance by the aforediscussed expedient of selecting that recess 25 of the actuator 5 which is to receive the arresting member 26 and the split ring or O-ring 101.

When the outflow of a maximum quantity of a smaller quantity of water from the tank 34 is completed, the tank 34 receives and collects fresh water which remains in the space 134 because the valving element 6 is then maintained in sealing engagement with the seat 33. The opening 8 is at least partially exposed at all times (i.e., it is not completely sealed by the valve 9) so that the level of water in the chamber 3 can rise toward the level of water in the space 134 of the tank 34.

FIG. 4 shows an adjustable mechanical connection or coupling between the rod 10 and the actuator 5. Such connection comprises pins or male detent elements 47 which are directly or indirectly connected to one of the parts 5 and 10, and complementary sockets or female detent elements **47*a* in the other of these parts. The connection of FIG. 4 can be used in lieu of the connection of FIG. 6**.

The rod 10 (and hence the valve 9) can be moved relative to the housing 1 in a number of different ways. For example, FIG. 7 shows a spherical knob 120 which is provided at the upper end of the rod 10 and serves to initiate a flushing operation in response to a first depression of the rod 10. A second depression of the rod 10 by way of the knob 120 can result in an interruption of the flushing operation, i.e., in a reduction of the quantity of water which is permitted to flow through the outlet 32 and into the toilet bowl. However, it is equally possible to pull the knob 120 in order to initiate a flushing operation and to depress the knob in order to effect an interruption of such operation. Alternatively, the apparatus can be designed in such a way that a first pull upon the knob 120 initiates the start of a flushing operation and that such operation is interrupted in response to a second pull upon the knob 120. Still further, it is possible to design the apparatus in such a way that a push upon the knob 120 initiates a flushing operation which continues as long as the knob 120 is held in the depressed position. The mode of operation can be reversed by starting the flushing operation as a result of lifting of the knob 120, and such operation is interrupted or terminated when the application of lifting force is terminated.

The actuator 5 can be used as a means for evacuating surplus water from the tank 34 into the toilet bowl while the valving element 6 remains in sealing engagement with the seat 33. Thus, the upper end or the upper portion of the actuator 5 has an inlet, and the preferably tubular actuator defines a passage for the flow of liquid from the inlet directly into the toilet bowl. When the body of water in the tank 34 rises to the level of the inlet of the actuator 5, the surplus simply flows through the actuator, i.e., in the aforementioned passage of the actuator, and into the outlet 33 go enter the toilet bowl.

The means for supplying water into the tank 34 is described and shown, for example, in commonly owned U.S. Pat. No. 4,800,596 granted Jan. 31, 1989 for "Ventilated Toilet". The disclosure of this patent is incorporated herein by reference.

The level of the inlet of the actuator 5 can be adjusted by the arresting member 26 (namely by installing the member 26 in a different recess), by a suitable extension to locate the inlet at a greater distance from the outlet 33, or by removing a portion of the actuator.

FIGS. 7 and 8 illustrate a portion of a second apparatus which employs the aforementioned leaf spring 113 in lieu of the coil springs 16, 19 and which further comprises the aforediscussed knob 120 as an operating means for moving the rod 10 relative to the housing 1. The apparatus of FIGS. 7 and 8 is designed in such a way that a single application of force to the rod 10 suffices to initiate a full flushing operation (i.e., the evacuation of a maximum quantity of water from the tank 34) or a less pronounced flushing operation which results in the flow of a smaller quantity of water into the toilet bowl. The user of the toilet can select the (minimum or maximum) quantity of water to be discharged into the toilet bowl, preferably by pulling upon the knob 120 in order to initiate the evacuation of a maximum quantity of water and by pushing the knob 120 in order to initiate the evacuation of a minimal quantity of water (or vice versa).

The apparatus of FIGS. 7 and 8 further comprises a magnetic valve 103 which can be operated by a device including an elongated rod or bar 104 (hereinafter called bar to distinguish from the displacing rod 10 for the valve 9). The bar 104 is coupled to the rod 10 which latter is adjacent and parallel to the bar. The magnetic valve 103 comprises a buoyant member 108 which is disposed in the chamber 3 of the housing 1 and the underside of which is adjacent an annular permanent magnet 107. The latter is attracted to a magnetizable member 106 which is outwardly adjacent the neighboring portion of the housing 1. The magnet 107 (which shares the movements of the buoyant member 108) is attracted to the magnetizable member 106 when the apparatus is idle, i.e., when the outlet 32 (not shown in FIGS. 7 and 8) of the tank 34 is sealed by the valving element 6 of the actuator 5 (not shown in FIGS. 7 and 8). The magnetizable member 106 is disposed beneath an opening or aperture 109 in the adjacent portion of the housing 1. The parts 106, 107 of the valve 103 then cooperate to seal the aperture 109. The bar 104 extends through registering holes or passages of the buoyant member 108, magnet 107 and magnetizable member 106. The bar 104 is provided with an enlarged portion (e.g., a collar) 110 which is located at the magnetic valve 103 and can neither move through the passages of the member 108 and magnet 107 nor through the passage of the magnetizable member 106. Thus, when the knob 120 is depressed to move the rod 10 and the bar 104 downwardly, the enlarged portion 110 passes (from the position of FIG. 7) through the magnet 107 and pushes the magnetizable member 106 downwardly and away from the magnet 107. This enables the buoyant member 108 to lift the magnet 107 and to thus enable the aperture 109 to permit water to flow between the internal space 134 of the tank 34 and the internal chamber 3 of the housing 1. While moving downwardly and away from the magnet 107, the magnetizable member 106 is caused to stress a coil spring 111 which surrounds the bar 104 at a locus outside of the housing 1 and beneath the aperture 109. The magnet 107 can rise with the buoyant member 108 as soon as the distance between the parts 106,. 107 of the valve 103 reaches a preselected value, i.e., as soon as the knob 120 has been depressed to a predetermined extent. The direction of upward movement of the buoyant member 108 and magnet 107 in the chamber 3 of the housing 1 is determined by the bar 104.

If the operator then relaxes the pressure upon the knob 120, the magnetizable member 106 is lifted by the coil spring 111 to rise toward the underside of the adjacent portion of the housing 1. This does not result in sealing of the aperture 109 because the latter can be sealed only by the magnet 107 or by the magnet 107 in conjunction with the magnetizable member 106. For example, the magnetizable member 106 can be provided with slots or it can be imparted a cruciform or star-shaped configuration to establish one or more paths for the flow of water between the internal space 134 of the tank 34 and the chamber 3 of the housing 1. The dimensions of the aperture 109 are preferably selected in such a way that, when the magnetic valve 103 is open, the level of water in the housing 1 sinks at the same rate 6 or nearly the same rate) as in the internal space of the tank 34. The aperture 109 is closed in a fully automatic way when the buoyant member 108 is free to lower the magnet 107 to the position of FIG. 7 while the magnetizable member 106 is biased against the housing 1 by the spring 111, i.e., the member 106 is free to attract the magnet 107 and to thus ensure that the aperture 109 is resealed.

If the operator decides to pull the knob 120 and hence the rod 10, the enlarged portion 110 of the bar 104 is lifted so that the buoyant member 108 is entrained by the portion 110 or is free to rise due to its buoyancy. In either event, the member 108 causes the magnet 107 to rise above the magnetizable member 106, i.e., the attracting force of the magnetizable member 106 is overcome and the aperture 109 is free to permit water to flow between the chamber 3 of the housing 1 and the internal space 134 of the tank 34. From there oh, the operation of the apparatus of FIGS. 7 and 8 is the same as described hereinbefore in connection with depression of the knob 120.

The magnetic valve 103 is located at a level above the valve 9 for the opening 8 in the bottom wall 7 of the housing 1. Therefore, the magnetic valve 103 can seal the aperture 109 before the valving element 6 of the actuator 5 can seal the outlet 32 of the tank 34. Thus, when the valve 103 already seals the aperture 109, the opening 8 continues to permit an equalization of the levels of upper surfaces of the bodies of water in the tank 34 and housing 1. In other words, sealing of the aperture 109 by the valve 103 does not terminate the outflow of water from the tank 34 into the toilet bowl because the valving element 6 is still in the process of descending (with the float 4) toward and into sealing engagement with the seat 33 around the outlet 32 of the tank 34.

Another advantage of the feature that the magnetic valve 103 is installed in the housing 1 at a level above the opening 8 for the valve 9 is that an operator can proceed, if and when necessary, to initiate additional flushing of the toilet bowl when the flushing with a minimal quantity of water is completed. In other words, the operator can cause the apparatus to discharge a minimal quantity of water from the tank 34 into a toilet bowl and to thereupon discharge (if necessary) an additional quantity (namely the remainder) of water from the internal space 134 of the tank 34, through the outlet 32 and into the toilet bowl. All that is necessary is to again depress the knob 120 with attendant depression of the rod 10 and bar 104.

The bar 104 extends through a hole or bore 112 in the aforementioned leaf spring 113 and through a bore or hole 114 of a leaf spring 115 which is located beneath the magnetic valve 103. The bar 104 has an enlarged portion or abutment 116 which is connected with the lowermost convolution of the coil spring 111 to bear against the upper side of the leaf spring 115. The portion 116 cannot pass through the hole or bore 114 of the leaf spring 115. When the knob 120 is depressed, the bar 104 moves downwardly with the rod 10 and the portion 116 of the bar 104. 116 depresses the leaf spring 115. However, the leaf spring 115 reassumes the position of FIG. 7 by dissipating energy when the pressure upon the knob 120 is interrupted or terminated. This causes the enlarged portion 110 of the bar 104 to rise to the level of FIG. 7, i.e., to the level of the magnet 107. In other words, the leaf spring 115 ensures that the bar 104 is normally maintained in a predetermined neutral position.

The mode of operating the rod 5 and the bar 104 by way of the knob 120 can be adjusted in order to alter the timing of initiation and termination or interruption of the flushing operation. The combined connecting and adjusting means is shown at 105 and constitutes a mechanical coupling between the rod 10 and the bar 104. This adjusting means 105 is movable up and down along the rod 10 and comprises a U-shaped yoke-like adjusting member having an upper leg 124, a lower leg 125 and a web 123 between the legs 124 and 125. The legs 124, 125 are traversed by and frictionally engage the rod 10, and the latter is parallel or nearly parallel to and spaced apart from the web 123. As can be seen in FIGS. 9 and 10, the web 123 and the adjacent portion of the rod 10 define an elongated vertical clearance 122 which receives a horizontal arm 126 at the upper end of the bar 104. The level of the U-shaped adjusting member of the adjusting means 105 relative to the rod 10 is selected in such a way that the arm 126 of the bar 104 abuts or is adjacent the upper leg 124 or the lower leg 125 of the adjusting member or is located Substantially in the middle of the clearance 122. FIG. 9 shows the arm 126 at the lower leg 125, and FIG. 10 shows the arm 126 somewhere between the legs 124 and 125. In FIG. 7, the arm 126 is located at the upper leg 124. When the adjusting means 105 is moved to the position of FIG. 7, flushing with the maximum quantity as well as with a lesser quantity of water is effected by depressing the knob 120. Flushing with the full quantity of water is initiated in response to a slight depression of the knob 120 such as suffices to lift the valving element 6 off the seat 33 around the outlet 32 of the tank 34. The valving element 6 is lifted by the yoke 22 and float 4 in response to depression of the knob 120 at the upper end of the rod 10. However, the extent of depression of the knob 120 should be less than that which is necessary to lift the magnet 107 sufficiently above the magnetizable member 106 so that the aperture 109 is fully exposed in order to permit maximum flow of water between the chamber 3 and the internal space 134 of the tank 34. If the person using the toilet decides that the quantity of flushing water is to be reduced below the maximum quantity, slight depression of the knob 120 is followed by more pronounced depression so that the magnetic valve 103 opens and the aperture 109 permits rapid evacuation of water from the chamber 3 whereby the valving element 6 rapidly descends toward and sealingly engages the seat 33 to thus interrupt further outflow of water from the tank 34 into the toilet bowl.

FIG. 9 shows the adjusting means 105 in a position in which a lifting of the rod 10 by way of the knob 120 results in lifting of the bar 104 and enlarged portion 110. Slight lifting of the rod 10 results in evacuation of a maximum quantity of water from the tank 34 into the toilet bowl. However, if the user decides to lift the rod 10 all the way, the enlarged portion 110 of the bar 104 can lift the buoyant member 108 of the valve 103 to such an extent that the magnet 107 is no longer attracted by the magnetizable member 106. This results in rapid evacuation of water from the chamber 3 into the space 134 of the tank 34 and in more rapid descent of the valving element 6 into sealing engagement with the seat 32, i.e., the quantity of water which has been discharged into the toilet bowl prior to sealing of the outlet 32 is reduced accordingly.

If the adjusting means 105 is moved to the intermediate position of FIG. 10, the apparatus is set up for normal flushing (with a maximum quantity of water) regardless of whether the knob 120 is manipulated to lift or to depress the rod 10. In other words, the apparatus is then not ready to reduce the quantity of flushing water below the maximum quantity.

The positions of the magnet 107 and magnetizable member 106 can be interchanged without departing from the spirit of the invention.

An important advantage of the improved apparatus is that it enables the user of the toilet to select the quantity of flushing liquid, e.g., to select a maximum quantity or a minimum quantity, as well as to switch to flushing with a minimum quantity while the flushing operation is already in progress. This entails considerable savings in flushing liquid with attendant savings for operation of sewage treatment plants. Moreover, it is possible to decide, while the flushing operation is in progress, whether or not a reduced quantity of liquid will suffice to adequately flush the toilet bowl. Still further, the operation of the apparatus is highly predictable and reproducible.

Another important advantage of the improved apparatus is its compactness. Thus, the housing 1 and the regulating means including the parts 9 and 10 can be confined in a flushing tank of average size or even in a relatively small tank.

A further important advantage of the improved apparatus is its simplicity. Thus, it is merely necessary to provide the housing 1 with an opening 8 and to install in the housing a regulating unit including the valve 9 and the rod 10. These parts can directly or indirectly influence the rate of descent of the valving element 6 into sealing engagement with the seat 33 around the outlet 32 of the tank 34. The rod 10 can move the valve 9 to a position in which the opening 8 is nearly sealed and to one or more additional positions in which the opening 8 is at least partially exposed to permit water to flow between the chamber 3 and the internal space 134 at a selected rate. Such simplicity of the regulating unit including the valve 9 and the rod 10 renders it possible to employ simple additional parts which are necessary for the aforediscussed mode of operation of the improved apparatus. These simple parts (including the yoke 22, the adapter 48 and others) contribute to lower cost of and enhance the reliability of the apparatus. The adjustments of the apparatus in order to select the minimum quantity of flushing liquid are equally simple. Thus, all that is necessary is to select the level of the housing 1 relative to the outlet 32 of the tank 34.

An advantage of such design of the improved apparatus that the actuator 5 is at least substantially parallel to the rod 10 is that a single operating member (for example, the knob 120 of FIG. 7) suffices to initiate a flushing operation as well as to select the level of the valve 9. As already described hereinabove, the operating member can be used to initiate a flushing operation in response to a first axial displacement of the rod 10 and to interrupt the flushing operation in response to the next-following shifting of the rod 10. Such simplicity of the means for initiating and interrupting or terminating a flushing operation renders it possible to simplify the construction of the cover of the tank 34 because the cover can be traversed by a single part, such as the upper portion of the rod 10 which carries the knob 120. The provision of a single knob 120 for of an equivalent of this knob) as a means for operating the apparatus for the purpose of effecting a flushing with a maximum quantity as well as with a reduced quantity of flushing liquid is particularly desirable and advantageous when the improved apparatus is installed in the tank of a public toilet in an airport, rail or bus terminal, in a school, in another public building or in a similar establishment which is likely to be accessible to vandals.

The locating device 11 constitutes an optional but desirable and advantageous feature of the improved apparatus. This device ensures that the rod 10 is properly guided relative to the housing 1 and float 4 regardless of whether the valve 9 is moved into, upwardly and away from or downwardly and away from the opening 8 in the bottom wall 7 of the housing 1. The illustrated locating device 11 can be said to resemble or constitute a cage for the valve 9.

The float 4 can be made of a suitable buoyant material. If such material is not sufficiently resistant to stresses or is likely to be affected by direct contact with flushing liquid, at least a portion of the float can be confined in a suitable jacket or envelope **4*a* which is shown in FIG. 1. For example, the jacket 4*a* can constitute a plastic foil which is shrunk onto the float 4 under the action of heat. The jacket 4*a* can further serve as a means for reducing the likelihood of damage to the float 4 in the event of jamming in the chamber 3**.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for flushing a toilet bowl, comprising a tank having a liquid confining space and an outlet for admission of liquid into the bowl; a housing having a chamber and an opening connecting said chamber with said space; a float provided in said chamber and arranged to descend in response to flow of liquid from said chamber; an actuator arranged to descend with said float, said actuator including a valving element and being movable to and from an operative position in which said valving element seals said outlet to prevent the flow of liquid from said space into the bowl; and means for regulating the movements of said actuator, said regulating means comprising means for controlling the rate of flow of liquid from said chamber into said space via said opening, and said controlling means having a first position in which liquid flows through said opening at a first flow rate, while said float and actuator descend at a first sink rate, so that said valving element seals said outlet upon evacuation of a first quantity of liquid through said outlet, said controlling means further having a second position in which liquid flows through said opening at a lower second flow rate, while said float and actuator descend at a lower second sink rate, so that said valving element seals said outlet upon evacuation of a greater second quantity of liquid through said outlet.

* * * * *